US005500952A

United States Patent [19]

Keyes

[11] Patent Number: 5,500,952

[45] Date of Patent: Mar. 26, 1996

[54] HIP INFLATABLE PROTECTION DEVICE

[76] Inventor: Marshall J. Keyes, 3920 Kingswood Rd., Sherman Oaks, Calif. 91403

[21] Appl. No.: 331,085

[22] Filed: Oct. 28, 1994

[51] Int. Cl.[6] ..... A41D 13/00

[52] U.S. Cl. ..... 2/2; 2/DIG. 3; 2/908; 441/108; 441/93

[58] Field of Search ..... 2/DIG. 3, 2, 908, 2/912; 441/92, 93, 108, 113, 96; 280/728 R, 729, 733; 222/3

[56] References Cited

U.S. PATENT DOCUMENTS

| | | | |
|---|---|---|---|
| 3,895,396 | 7/1975 | Amarantos | 441/108 X |
| 3,921,944 | 11/1975 | Morrison . | |
| 4,059,852 | 11/1977 | Crane . | |
| 4,089,065 | 5/1978 | McGee . | |
| 4,379,705 | 4/1983 | Saotome . | |
| 4,626,221 | 12/1986 | Rocco | 441/113 X |
| 4,637,074 | 1/1987 | Taheri . | |
| 4,737,994 | 4/1988 | Galton | 2/DIG. 3 X |
| 4,825,469 | 5/1989 | Kincheloe . | |
| 4,977,623 | 12/1990 | DeMarco . | |
| 5,368,512 | 11/1994 | Brown . | |
| 5,402,535 | 4/1995 | Green | 2/413 X |

FOREIGN PATENT DOCUMENTS

| | | | |
|---|---|---|---|
| 2573382 | 5/1986 | France | 441/108 |
| 2184069 | 6/1987 | United Kingdom | 441/113 |

*Primary Examiner*—Paul C. Lewis
*Attorney, Agent, or Firm*—Poms, Smith, Lande & Rose

[57] ABSTRACT

The invention is a self-contained protective device/system designed to protect the hips, pelvis, buttocks, and coccyx areas of the user. The device may be worn outside of the clothing. Because it is small in size and lightweight, it may be easily put on and removed and does not interfere with body movements. It contains the following components: an inflatable air bag folded into pleats, a battery, a gas cartridge, sensors to determine angular motion and acceleration, a triggering/valve mechanism to release the gas and a relief valve. When the user falls, the sensors automatically release gas from the cartridge and inflate the airbag assembly, forcing the folded pleats to fully cover said areas of the user's body. After use the relief valve is opened to release air from the airbag assembly, the pleats are reinserted into the system and the invention is ready for reuse after the spent cartridge is replaced. The invention is superior to prior art because of its automatic deployment, compact size, light weight, ease of use and reusability. In this embodiment it will afford much needed protection to the elderly and infirm.

15 Claims, 2 Drawing Sheets

Fig. 2.
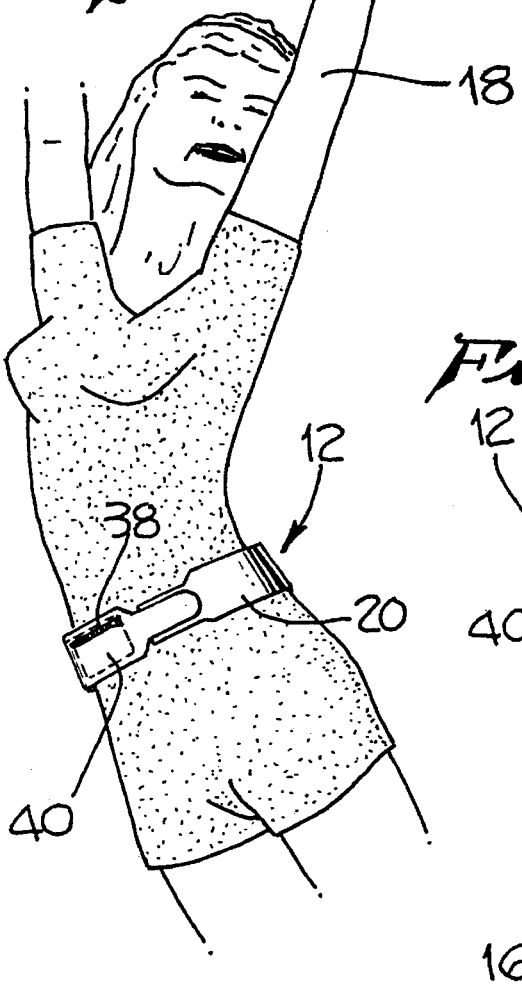
Fig. 4.
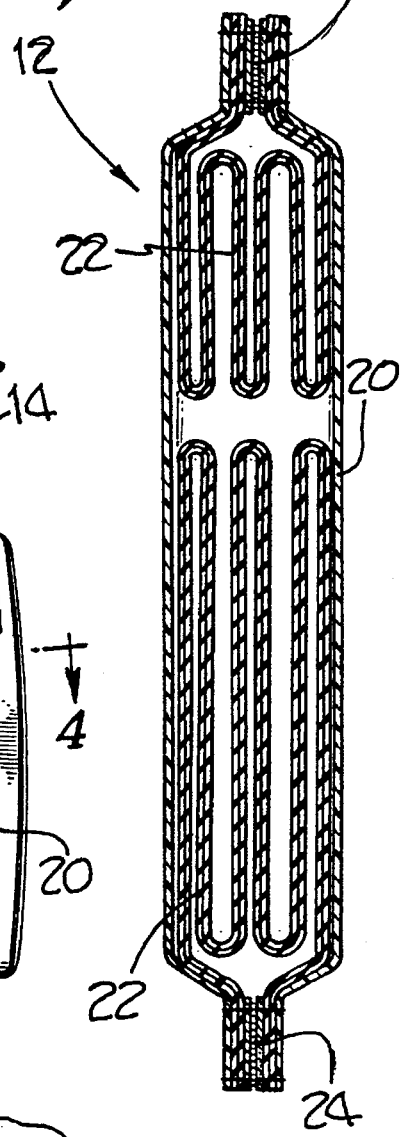
Fig. 1.
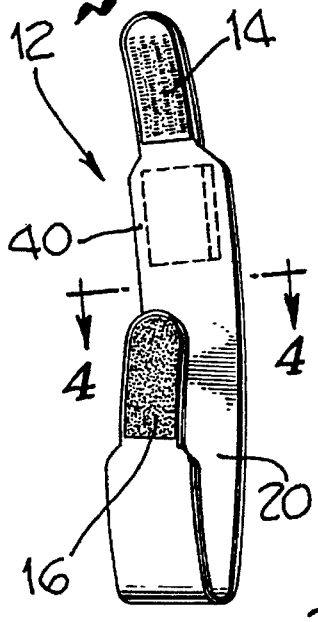
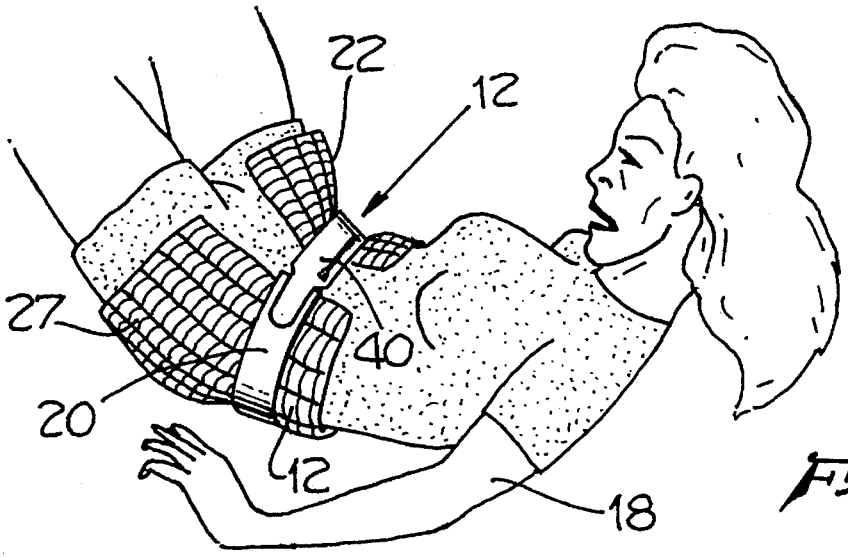
Fig. 3.

HIP INFLATABLE PROTECTION DEVICE

BACKGROUND OF THE INVENTION

Hip fractures are a major health and economic problem for the elderly and our society as a whole. Treatment for hip fractures includes surgery and prolonged periods of bed rest, both of which expose patients to significant complications such as infection and pneumonia. Recovery, either complicated or uncomplicated, can result in significant disturbance in the life of a patient and his/her family, and substantial medical costs. After hip fracture, many elderly patients may need to further restrict their activities, need a "walker," be confined to a wheelchair and often require full or part-time assistance. As a significant causes of disability and death in the elderly, the number and importance of hip fractures will surely increase as the number and percentage of the elderly increases.

In 1990 it was estimated that the number of hip fractures in persons over the age of 50 would increase from 238,000 to 512,000 per year by 2040 with an increase in cost from $7.2 billion to $16 billion per year! This was based on an average cost of $29,800 per hip in 1984 dollars, assuming no change in the average cost and a 3% to 5% increase for inflation. No value can be placed on the pain and suffering of the injured and the burden on family and friends who care for them.

According to the "Tufts University Diet & Nutrition Letter" Vol. 12 No. 4, June 1994, "...As many as 20 percent of all people who suffer a hip fracture die within a year, usually because of complications like pneumonia or blood clots in the lung that are related to either the fracture itself, surgery to heal the break, or being confined to bed..."

There has been little progress in the prevention of hip fractures despite our growing knowledge about contributing factors. Diet, calcium supplements and exercise, which help strengthen elderly bones may be helpful, but probably will not significantly decrease the incidence of hip fractures.

The hip joint is a ball and socket (enarthrodial) joint formed by the cup-shaped cavity in the pelvic bone (acetabulum) and the ball-shaped head of the upper leg bone (femur). The lateral hip and particularly the area of the trochanter, an area of bone which protrudes outwardly from the femur just below the hip joint, is particularly vulnerable to injury and fracture. This vulnerability results from the lateral position and relatively thin layer of overlying muscle and fat.

The protective device is a marked improvement over the design and function of prior art for a number of significant reasons. These reasons and other unique features of the invention will be fully discussed.

Prior art for garments to protect the hip do not combine protection, comfort and ease of use. Girdle-like undergarments, whether essentially pads or inflatable bags, are difficult to put on and take off, and may create significant other problems for elderly people. Examples of such devices are U.S. Pat. Nos. 4,737,994; 5,297,293, 4,977,623. If such garments are not completely moisture resistant they will soon become dirty and probably soiled with urine and feces. The result is unsanitary, unpleasant, unsightly and uncomfortable for patients and attendants. Additionally, such garments, which by their very nature must fit snugly, can compromise blood circulation and could contribute to the development of decubitus ulcers, a dangerous problem with significant morbidity and even mortality in elderly, immobile and bedridden patients.

Other prior art is not designed for use in the elderly and does not contain important design features found in this protective device. Examples of this are U.S. Pat. No. 4,825,469 which in all its embodiments is designed to protect motorcycle riders, is too large and wide for use by the elderly, will restrict body movement and activities of daily living, employs an external source of compressed gas which is connected to the invention by a tube and is inflated mechanically by a string when the rider is thrown from the motorcycle. U.S. Pat. No. 4,059,852 for cyclists and 4,089,065 for mountain/rock climbing, hang gliding, race car driving, piloting and white water canoeing are full body devices, manually inflated and clearly not "automatic" or intended for use by the elderly. U.S. Pat No. 4,984,821 describes a gas expansion safety cloth for motorcyclists which is fired by a pull string and has external gas storage and discharge device which inflates the cloth when the wearer is thrown from the cycle. It is clearly not for use in the elderly. U.S. Pat. No. 4,637,074 is intended for use in automobile accidents, is too large for use by the elderly, and has external sensing, firing and compressed gas cartridge. U.S. Pat. No. 3,921,944 is bulky, not easily put on, removed or worn, and is inappropriate for use by the elderly. U.S. Pat. No. 4,089,065, particularly suitable for hang-gliding or parachuting, is not intended for the elderly because it is a full jacket and/or pants garment, bulky, intended to be worn only during those high risk activities and is manually activated.

In the development of this protective device it was most logical to look towards the airbag, also known as the Safety Air Cushion (SAC). This practical device was invented and designed to protect drivers and passengers in automobile accidents. Examples of airbags and airbag inflation devices are found in U.S. Pat. Nos. 3,430,979, which uses pressurized gas for inflation; 4,178,016 and 4,243,248, which both use pyrotechnic devices for inflation.

The protective device, in contrast to prior art, does not depend on internal fastening devices which cannot be visually inspected, can fail to align properly after deflation (thus compromising function on the next inflation) and may wear out at an accelerated rate. An example of such design is U.S. Pat. No. 4,089,065.

In contrast, the invention, when uninflated, uses very thin external Velcro-type straps to keep the pleats in place. In other embodiments the invention may keep the pleats in place with snaps, which will easily separate on inflation.

The invention, in contrast to prior art, does not depend on multiple separate inflatable chambers for coverage of the body areas to be protected. Such devices may not fully protect all the areas if one of the inflatable air chambers fails to inflate and fully expand. This is because the inflation and movement of any one air chamber to cover an area of the body is dependent upon the full inflation and movement of the adjacent chambers. This is particularly true for the uppermost and lowermost body areas protected by the device. U.S. Pat. No. 4,825,469 is an example of such a device.

In contrast, the protective device is comprised of an airbag or airbags with portions folded into several pleats contained within the device, which on inflation expand out of the protective device to cover the entire body area to be protected. Inflation and expansion are not hindered by internal attachments between the pleats.

The protective device described in this application fills an important need in preventive medical care for the elderly. The invention, in this embodiment, for the first time provides a simple, comfortable, easily worn self-contained, automatic device which provides maximum protection to the hip, pelvis, buttocks and coccyx areas in falls and does not interfere with activities of daily living.

SUMMARY OF THE INVENTION

The invention is a protective device worn by people, primarily elderly, to prevent hip fractures and provide protection for the hip, pelvis, buttocks and coccyx. The protective device is like a belt or cummerbund and is worn over clothing about the waist and held in place by either overlapping Velcro-type strips (hook and loop type fastening pads or strips) on areas or by a traditional fastening such as strap and loop securing arrangements. The protective device will be comprised of:

a. The protective device is a belt-like or cummerbund-like garment worn comfortably about the waist.

b. The protective device can be easily put on, adjusted to fit comfortably and removed by a person who is elderly, infirm or whose fingers, hands and grip have been weakened by arthritis and/or other neuromuscular conditions, or by a caregiver with minimal exertion and/or lifting. The invention does not have multiple straps, wraps, buttons or zippers. Anyone, either the wearer or an attendant, who can put a belt around his/her waist without putting it through belt loops can easily and quickly put the invention on or remove it.

c. The protective device is designed so as to be light and compact. To this end it will be made of the lightest possible material, examples of which are noted elsewhere in this document.

d. The invention will be designed to be as thin in width and short in height as possible in the uninflated state worn by the user. This will be accomplished with the use of folds or pleats in the material such that when it is uninflated the invention is as small as possible. When inflated the pleats inside the invention expand so that the device covers the hips, pelvis, buttocks and coccyx areas.

e. The protective device will be kept in position around the waist by a "one size fits" all strap which is an extension of one side of the invention and is placed across the other end of the invention and adheres to it by means of a Velcro-type strip on the respective inside of the strap and outside of the other end of the protective device. Alternatively, a simple buckle system can be used. The protective device may be secured around the waist of the user by either configuration.

f. The protective device does not interfere with the user's activities of daily living, primarily because of its small size, light weight and position around the waist. As with a belt or cummerbund, the wearer soon becomes totally unaware of its presence.

g. The protective device does not become soiled with feces or urine because it is located above and sufficiently distant from the anus and urethra in both males and females.

h. The invention will contain an inflatable airbag assembly, positioned so as to completely surround the hips, pelvis, buttocks, and coccyx areas when inflated. The airbag assembly will be inside two layers of strong, long lasting and abrasive resistant close-weave material such as the nylon used in the previously mentioned airbag devices (Neoprene coated woven Nylon). The fabric used would be made of high strength filaments in a weave sufficiently tight so as to hold gas pressure sufficiently high so as not to break upon the increase in pressure occasioned by the fall of the individual against the ground or another hard immobile, incompressible object with the garment between the person and the ground or an object. Examples of such suitable material would be the material currently being used by the manufacturers of automobile air safety bags, the material used in the highest quality life rafts or hot air balloons and possibly even Kevlar.

i. The invention will be inflated by a compressed gas cartridge fired by a motion detection triggering device. The device will work as follows: when the device senses body movement of a selected and predetermined acceleration (equal to or greater than the acceleration which occurs during a fall) and senses downward angular motion of selected and predetermined magnitude the device will signal the triggering mechanism to fire. This will release compressed gas from the compressed gas cartridge inflating the invention.

j. The invention will inflate only on changes in position sufficient in both acceleration, and downward angular motion so as to indicate a fall and cause the triggering device to discharge the compressed gas cartridge, thus releasing gas into the airbag assembly. This will eliminate the possibility of inappropriate firing during sitting and standing, sudden turning of the body, or travel in vehicles or elevators.

k. The motion sensor will contain logic controlled circuits which will not permit inflation of the airbag assembly unless signals are received indicating both sufficient acceleration of the body and sufficient downward angular motion.

i. The motion sensors may be either types of mercury switches or accelerometers or a combination of both. When predetermined rates of acceleration and downward angular motion are both detected by the sensor, the triggering mechanism will be activated causing the compressed gas cartridge to discharge thus inflating the invention.

ii. The signal from the sensors will drive piezoelectric crystals and/or cause small lightweight long-lasting batteries to activate the triggering device causing the discharge of the compressed gas cartridge and the inflation or the invention.

l. The invention, when inflated, expands to cover only the hip, pelvis, buttocks and coccyx areas. It does not cover or affect other areas of the body or impact nearby objects.

m. The invention maintains its inflation and impact absorbing quality until the manual relief valve is manually opened and the gas inside the airbag assembly escapes.

It should be clearly noted and understood that although the protective device described in this patent application is for the protection of the hip, pelvis, buttocks and coccyx areas, to prevent injury and fracture, this use is illustrative and exemplary only. It is not intended to be construed as limiting the invention to only this use or area of the body.

BRIEF DESCRIPTION OF THE DRAWINGS

FIG. 1 is a perspective view of the invention.

FIG. 2 is a perspective frontal view of the uninflated invention worn in position around the waist of a user.

FIG. 3 is a perspective frontal view of the inflated invention worn in position around the waist for a user who has fallen.

FIG. 4 is a cross-sectional view of the uninflated device taken along line 4—4 of FIG. 1.

DETAILED DESCRIPTION OF THE PREFERRED EMBODIMENT

Figure 5:
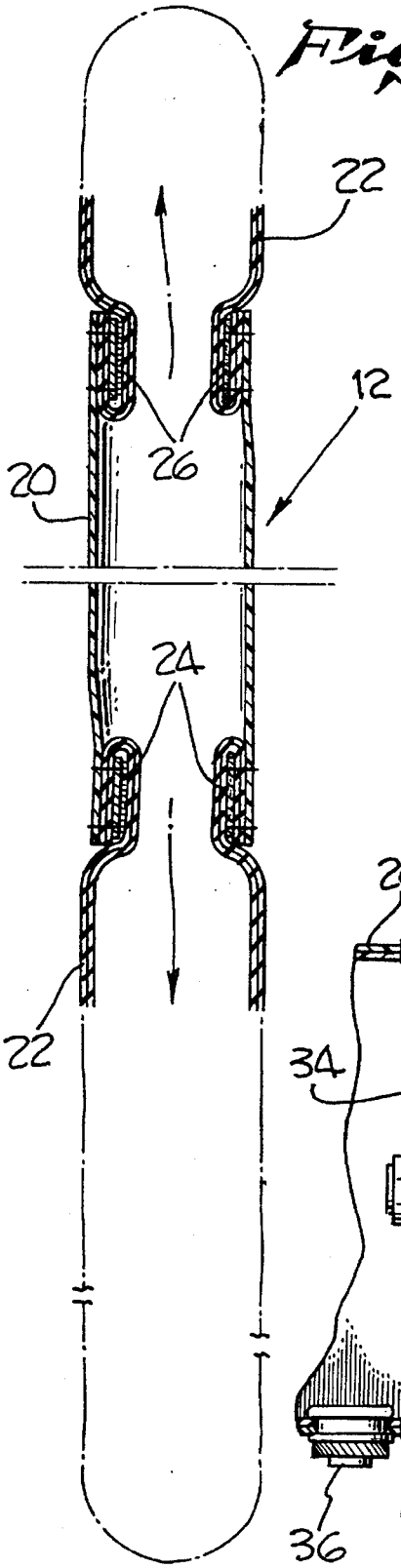
FIG. 5 is a cross-sectional view of the inflated device with the pleats expanded by gas pressure.

FIG. 1 is a perspective view of the protective device. In this embodiment the invention is a belt or cummerbund-like garment 12. The invention is worn about the waist and kept in place by means of Velcro-type hook and loop securing areas 14 and 16 on the inside of the right end of the invention and on the outside of the left end of the protective system.

FIG. 2 is a perspective frontal view of the uninflated protective device 12 worn in position around the waist of the user 18. Because it is light, compact, held in place by Velcro-type hook and loop securing areas and like a belt, it can be easily put on, adjusted to fit comfortably and removed by a person who is elderly, infirm, or whose fingers, hands and grip have been weakened by arthritis and/or other neuromuscular conditions or by a caregiver. This can be accomplished by the wearer or a caregiver/attendant with minimal exertion, lifting, or adjustment of multiple straps, wraps, buttons or zippers. The invention is made of light, strong, long-lasting, abrasion-resistant close weave material, such as the Neoprene coated woven Nylon used in airbag devices. Such fabric is strong enough, when tightly woven, to hold the increase in gas pressure which occurs when the user 18 falls against the ground or another incompressible object.

FIG. 3 is a perspective frontal view of the inflated protective device 12 on a user 18 who has fallen. The protective device 12 as shown in FIG. 4 includes an outer enclosing surface 20 and inner pleats and Velcro-type hook and loop closures 24 and 26 to hold the pleated portions of the airbag assembly in their compact uninflated configuration. Referring again to FIG. 3, note that the pleats 22 have inflated and expanded, pushing open the Velcro-type closure strips 24 and 26. When inflated the protective device covers the entire hip, pelvis, buttocks and coccyx areas. As indicated by the transverse lines on the expanded airbag assembly as shown in FIG. 3, the airbag assembly includes cross-ties 17 or other similar arrangements for preventing undue outward ballooning of the airbag assembly and to restrain it to the desired protective configuration as shown in FIG. 3. The thickness of the airbag assembly in its inflated state is such that it does not function as a fulcrum causing body parts outside the area covered by the airbag to strike the ground or other objects with greater force than they would have otherwise.

FIG. 4 is a cross-sectional view of the uninflated protective device 12. It demonstrates the folds or pleats 22 inside the protective device 12. Upon inflation, the pleats expand and force open the thin Velcro-type closure strips 24 and 26, which in the uninflated state keep the folded pleats 22 inside the outer enclosing surface 20.

FIG. 5 is an enlarged cross-sectional view of the inflated protective device 12. This view demonstrates the separation of the Velcro-type closure strips 24 and 26 and the position of the unfolded pleats 22 which have expanded and cover the hips, pelvis, buttocks and coccyx of the user (See FIG. 3).

Figure 6:
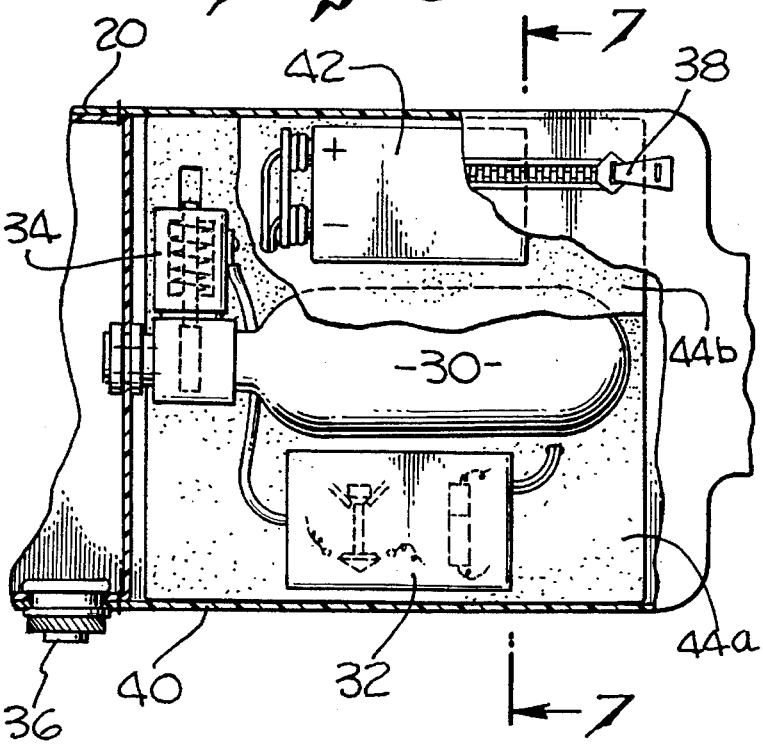
FIG. 6 is an enlarged view of the pocket containing the compressed gas cartridge, motion sensing devices, solenoid valve, battery and manual relief valve for deflation.

FIG. 6 is an enlarged cut away view of the pocket 40 containing the compressed gas cartridge 30, the motion sensor 32, the solenoid valve 34, the battery 42 and the manual deflation valve 36. The pocket is opened with a zipper 38 so as to allow sufficient room for removal, replacement or repair of any of its components including the compressed gas cartridge 30, the sensor 32, the solenoid valve 34 or the battery 42.

The steps involved in the inflation of the invention when the wearer falls are as follows: The sensor 32 detects the downward acceleration and angular motion, and causes the activation of the solenoid valve 34 to discharge the compressed gas cartridge 30, allowing the compressed gas to escape into the airbag assembly thus causing inflation and expansion of the pleats 22 to cover and protect the hip, pelvis, buttocks and coccyx (See FIG. 3).

Figure 7:
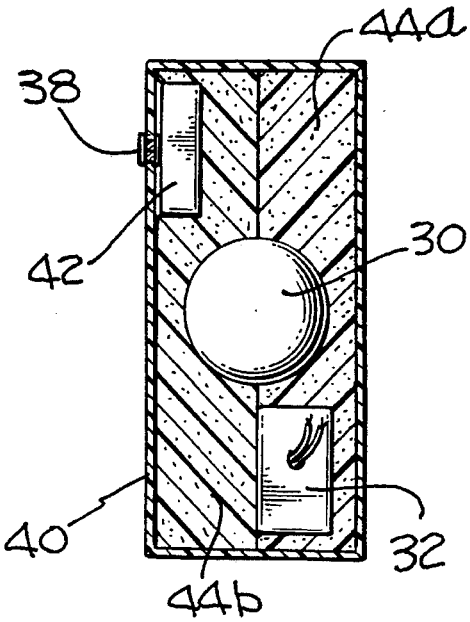
FIG. 7 is a cross sectional view taken along line 7—7 of FIG. 6.

FIG. 7 is a cross sectional view through the pocket taken along line 7—7 of FIG. 6. The reference numbers from FIG. 6 are carried over to the corresponding components in FIG. 7 including the battery 42 which powers the sensors 32 and the solenoid valve 34. Incidentally the sensors 32 may include acceleration and orientation sensors of any desired type including, but not limited to, a pendulous mass, a mercury switch and/or an accelerometer. Foam blocks **44*a* and 44*b*** may be used to prevent movement of the battery, sensors, solenoid valve and gas cylinder.

It is to be understood that the foregoing detailed description and accompanying drawings relate to a preferred illustrative embodiment of the invention. However, various changes and modifications may be made without departing from the spirit and scope of the invention. Thus, by way of example but not of limitation, instead of a solenoid valve, a single action valve or piercing member may be activated to puncture or cut a hole in a plastic outlet from the gas cylinder 30. Instead of the foam blocks shown in FIG. 7, foam or other cushioned padding may be employed. Regarding the sensor or sensors 32, any known form of angularly activated switch and any known type of accelerometer may be employed. Accordingly, the present invention is not limited to the specific arrangements as shown in the drawings and described in detail herein above. The exemplary materials, constructions and illustrations included in the preferred embodiment and this patent application should therefore not be construed to limit the scope of the present invention, which is defined by the appended claims.

What is claimed is:

1. A protective system worn outside clothing for preventing injuries to the user as a result of falls, the system comprising:

an elongated inflatable airbag assembly having upper and lower parts folded into pleats and adapted to cover the hips, pelvis, buttocks, and coccyx areas of the user's body when in an inflated state;

a belt for supporting said airbag assembly around the waist of a user, said belt defining a cavity and said airbag assembly being substantially within said cavity when in an uninflated state;

a sensor for detecting acceleration and a sensor for detecting angular movement, said sensors for producing a signal indicative of a predetermined combination of acceleration and angular movement, the predetermined combination corresponding to a fall; and a gas source adapted to release gas into said airbag assembly in response to said signal.

2. A system as defined in claim 1, wherein said sensors include an angular motion sensor and an accelerometer.

3. A system as defined in claim 1, wherein the belt defines opposite free ends, the system further comprising:

hook and loop type closure strips associated with the free ends to secure said belt around the user's waist; and hook and loop type closure strips associated with the pleats to hold the airbag assembly in a compact configuration.

4. A system as defined in claim 1, wherein said belt is approximately three inches in height and said airbag assembly expands approximately three inches upward and seven inches downward when gas from said cartridge is released and causes inflation of said airbag assembly.

5. A system as defined in claim 1, wherein at least one of said airbag assembly and said belt comprises an abrasion-resistant close weave material.

6. A system as defined in claim 1, further comprising:

a battery and a solenoid valve associated with said sensors and said gas cartridge;

wherein said battery, sensors, and gas source are housed within a pocket formed in said belt.

7. A system as defined in claim 6, further comprising blocks within said pocket adapted to prevent movement of said battery, sensors, and gas source.

8. A system as defined in claim 1 wherein said airbag assembly includes cross-ties to ensure that said airbag assembly does not balloon substantially outwardly when inflated.

9. A system as defined in claim 1, wherein said airbag assembly is composed of resilient elastomeric material.

10. A protective system for preventing injuries to at least one of the hips, pelvis, buttocks and coccyx of a user, the system comprising:

an elongate inflatable airbag assembly;

a belt for supporting said airbag assembly around the waist of a user, said belt having a cavity associated therewith and said airbag assembly being housed substantially within said cavity when uninflated;

sensing means for sensing acceleration and angular movement and for producing a signal indicative of a predetermined combination of acceleration and angular movement, the predetermined combination corresponding to a fall; and inflating means for inflating said airbag assembly to an expanded configuration in response to said signal.

11. A system as defined in claim 10, wherein said inflating means comprises a gas cartridge and a lightweight solenoid valve which releases compressed gas from said cartridge into said airbag assembly.

12. A system as defined in claim 10, wherein said airbag assembly covers at least one of the hips, pelvis, buttocks and coccyx of the user When in an inflated state.

13. A system as defined in claim 10, wherein said airbag assembly includes a plurality of outer enclosing surfaces and inner pleats which conform to at least one of the hips, pelvis, buttocks and coccyx of the user when in an inflated state.

14. A system as defined in claim 12, wherein said airbag assembly includes a plurality of outer enclosing surfaces and inner pleats which, when inflated, combine so as to conform to at least one of the hips, pelvis, buttocks and coccyx of the user.

15. A protective system for protecting at least a portion of the human body, comprising:

a belt adapted to be secured around the waist of a wearer, the belt defining a predetermined width measured along the spine of the user;

an inflatable airbag associated with the belt and adapted to be stored in a folded, uninflated state, the airbag defining a width measured along the spine of the user substantially equal to the width of the belt when the airbag is in the folded, uninflated state;

sensing means for sensing acceleration and angular movement and for producing a signal indicative of a predetermined combination of acceleration and angular movement, the predetermined combination corresponding to a fall; and inflating means, associated with the belt, for inflating the airbag to an unfolded, inflated state in response to said signal, the air bag defining a width substantially greater that the width of the belt when in the unfolded, inflated state.

* * * * *